US009223270B2

(12) United States Patent
Sayama

(10) Patent No.: US 9,223,270 B2
(45) Date of Patent: Dec. 29, 2015

(54) IMAGE FORMING APPARATUS CONTROLLING TONER IMAGE IN FORCED LASER BEAM EMISSION STATE AND METHOD THEREOF

(71) Applicant: KYOCERA Document Solutions Inc., Osaka (JP)

(72) Inventor: Haruki Sayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/604,179

(22) Filed: Jan. 23, 2015

(65) Prior Publication Data

US 2015/0212455 A1 Jul. 30, 2015

(30) Foreign Application Priority Data

Jan. 29, 2014 (JP) ..... 2014-014155

(51) Int. Cl.
*G03G 15/16* (2006.01)
*G03G 15/23* (2006.01)
*G03G 15/00* (2006.01)

(52) U.S. Cl.
CPC ..... *G03G 15/234* (2013.01); *G03G 15/5037* (2013.01)

(58) Field of Classification Search
CPC ..... G03G 15/50; G03G 15/16
USPC ..... 399/66, 19
See application file for complete search history.

(56) References Cited

U.S. PATENT DOCUMENTS 4,965,634 A * 10/1990 Bando ..... 399/49
2008/0145071 A1* 6/2008 Ogasawara ..... 399/28
2009/0016749 A1* 1/2009 Mashiba ..... 399/39
2014/0064747 A1* 3/2014 Numazu ..... 399/19

FOREIGN PATENT DOCUMENTS

JP 6-175514 A 6/1994

* cited by examiner

*Primary Examiner* — Billy Lactaoen
*Assistant Examiner* — Arlene Heredia Ocasio
(74) *Attorney, Agent, or Firm* — Stein IP, LLC

(57) ABSTRACT

The forced light emission detection unit detects a forced laser beam emission state of an exposing unit when the exposing unit starts forming a latent image on a photosensitive drum. The toner transfer control unit performs the developing of the electrostatic latent image formed at a position before the electrostatic latent image on which the forced laser beam emission state is detected, and transfers the developed toner image to a sheet. The sheet re-conveyance unit makes the sheet being in a re-conveyance state using a duplex printing conveyance path. The toner re-transfer control unit reforms the electrostatic latent image formed after the position on which the force laser beam emission state is detected, performs the developing of the electrostatic latent image, and transfers the developed toner image to the sheet in the re-conveyance state.

8 Claims, 7 Drawing Sheets

IMAGE FORMING APPARATUS CONTROLLING TONER IMAGE IN FORCED LASER BEAM EMISSION STATE AND METHOD THEREOF

CROSS-REFERENCE TO RELATED APPLICATIONS

This application claims priority to Japanese Patent Application No. 2014-014155 filed Jan. 29, 2014, the entire contents of which are incorporated by reference herein.

BACKGROUND OF THE INVENTION

The present disclosure relates to an image forming apparatus and an image forming method.

There are many kinds of conventional techniques with respect to the image forming apparatus like the multifunction peripheral, the copying machine and the printer. An image recording apparatus is configured to apply a specific current or voltage on a transfer unit as a transfer bias for environment detection till an electrified part of an image carrier arrives at the transfer position after starting the recording, and control recording conditions of the image recording apparatus based on an output of the specific current or voltage. In the apparatus, it is possible to shorten a pre-rotation time of the image carrier (a time till an input of the image data after the print ON signal) that is a factor to shorten the first print output time, and output the image data with high quality.

In case of the printing by the laser printer, before the toner image is transferred to a sheet, a laser beam from an exposing unit is irradiated on a photosensitive drum to change the electrical potential of the photosensitive drum, and a latent image is formed (developed) on the electrified position on the photosensitive drum. When the sheet faces the electrostatic latent image, the laser printer applies the bias on the transfer unit, and the transfer unit transfers toner to the image to form a toner image, and the fixing unit fixes the toner image on the sheet, and the printed sheet is outputted.

When a noise caused by an external factor, such as an enable signal, is inputted to the exposing unit for irradiating the laser beam, the exposing unit becomes an abnormal state, namely, a mode of emitting the laser beam forcedly. At the forced laser beam emission mode, even though the other units are in a normal state and going on forming the electrostatic latent image, the exposing unit continues to irradiate the laser beam on the photosensitive drum. Therefore, the laser beam emission continues during the time for forming the electrostatic latent image (at the receipt of the BEAM DETECT signal). As a result, a horizontal line appears in the electrostatic latent image on the photosensitive drum, which is an abnormal latent image not corresponding to the image data.

The sheet printed based on the state of the abnormal latent image is not considered as a normal printed matter, which causes the waste of sheets and toner. The conventional image forming apparatus cannot settle such trouble when the abnormal latent image occurs. The above-mentioned technique cannot resolve such trouble.

SUMMARY OF THE INVENTION

An image forming apparatus in accordance with embodiments of the present disclosure includes a forced light emission detection unit, a toner transfer control unit, a sheet re-conveyance unit and a toner re-transfer control unit.

The forced light emission detection unit detects a forced laser beam emission state that an exposing unit irradiates a laser beam continuously when the exposing unit starts forming a latent image on a photosensitive drum. The toner transfer control unit performs the developing by moving a toner to the electrostatic latent image formed at a position before the electrostatic latent image on which the forced laser beam emission is detected when the exposing unit is in a forced laser beam emission state, and transfers a toner image formed by the developing to a sheet. The sheet re-conveyance unit makes the sheet being in a re-conveyance state by means of a duplex printing conveyance path, the sheet on which the toner image is transferred. The toner re-transfer control unit reforms the electrostatic latent image formed after the position on which the force laser beam emission state is detected, performs the developing by moving the toner to the electrostatic latent image, and transfers the toner image formed by the developing to the sheet in the re-conveyance state.

An image forming method in accordance with embodiment of the present disclosure includes steps of a forced light emission detection step, a toner transfer control step, a sheet re-conveyance step and a toner re-transfer control step.

The forced light emission detection step detects a forced laser beam emission state that an exposing unit irradiates a laser beam continuously when the exposing unit starts forming a latent image on a photosensitive drum. The toner transfer control step performs the developing by moving a toner to the electrostatic latent image formed at a position before the electrostatic latent image on which the forced laser beam emission is detected when the exposing unit is in a forced laser beam emission state, and transfers a toner image formed by the developing to a sheet. The sheet re-conveyance step makes the sheet being in a re-conveyance state by means of a duplex printing conveyance path, the sheet on which the toner image is transferred. The toner re-transfer control step reforms the electrostatic latent image formed after the position on which the force laser beam emission state is detected, performs the developing by moving the toner to the electrostatic latent image, and transfers the toner image formed by the developing to the sheet in the re-conveyance state.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
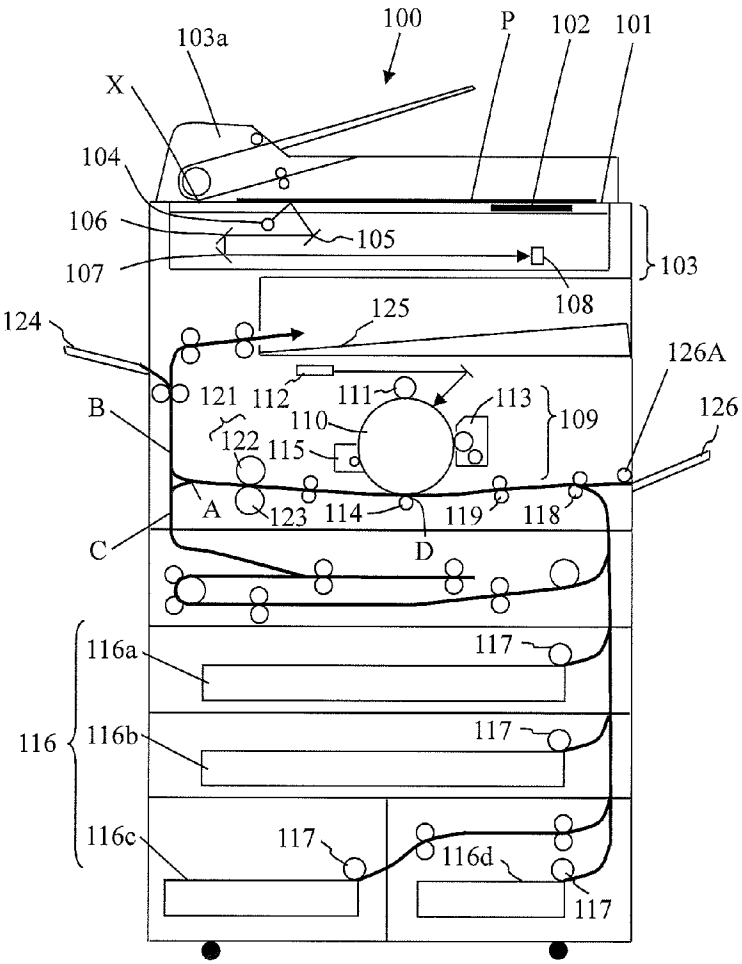
FIG. 1 is a schematic view of a multifunction peripheral in accordance with an embodiment of the present disclosure.

According to attached drawings, embodiments of the image forming apparatus in the present disclosure are explained hereinafter in order to understand the present disclosure. Besides, the following embodiments are only examples that realize the present disclosure, and do not limit the technical scope of the present disclosure. Additionally, the alphabet "S" in front of a numeral in the flowchart means a "step".

<Image Forming Apparatus>

The image forming apparatus (e.g. a multifunction peripheral) in the present disclosure is explained hereinafter. The parts that do not have direct connection to the present disclosure are explained briefly and the details are omitted.

The image forming apparatus 100 in the present disclosure corresponds to a printing device, a scanning device, or a multifunction peripheral provided with a printer, a copier, a scanner, and the facsimile machine. Besides, the operation of the multifunction peripheral 100 is described below briefly when the multifunction peripheral performs the duplex printing for an image of an original P.

When a user performs the copying by the multifunction peripheral 100, first, the user puts the original P on an original plate 101 on a top of the multifunction peripheral 100 and inputs a setting of the copying (the duplex printing, the sheet feed cassette) from an operation unit 102. In addition, the user presses down a start key on the operation unit 102 and let the multifunction peripheral 100 start the duplex printing.

At the beginning of the duplex printing process, the multifunction peripheral 100 starts reading the image on a front surface of the original P. In an image reading unit 103, the light emitted from a light source 104 is reflected on the front surface of the original P placed on the original plate 101. The reflected light is guided to an imaging element 108 by mirrors 105, 106 and 107. The guided light is photo-electrically converted by imaging element 108, and the image on the front surface of the original P is read as the image data of the front surface for the duplex printing.

Moreover, when the user reverses the original P and presses down the start key, the image of a back surface of the original P is read as the image data of the back surface for the duplex printing in the same manner as above. The read image data of the front and back surfaces are sent to an image forming unit 109, and transferred on a recording medium as a toner image.

Besides, it may be configured that the original P is supplied from an automatic document feeder 103*a* provided on the image reading unit 103, and the images of the both sides of the original P are read by the image reading unit 103. The automatic document feeder 103*a* is provided with an original conveyance path, a pickup roller and a conveyance roller; those are built in the platen cover. The original P is conveyed from the original plate 101 to a copy receiving tray through a reading position X where the image reading unit 103 reads the original. Otherwise, the automatic document feeder 103*a* may be configured to read the both surfaces of the original P in parallel by a specific reading member provided at a position facing the image reading unit 103 through the reading position X.

The image forming unit 109 is provided with a photosensitive drum 110. The photosensitive drum 110 rotates in a predetermined direction at a fixed speed. Around the photosensitive drum 110, a charging unit 111, an exposing unit 112, a developing unit 113, a transfer unit 114, and a cleaning unit 115 are arranged in order from the upstream side of the rotation direction.

The charging unit 111 electrifies a surface of the photosensitive drum 110 uniformly. The exposing unit 112 irradiates the laser beam on the surface of the electrified photosensitive drum 110 according to the image data of the front surface, and forms an electrostatic latent image. The developing unit 113 sticks the toner on the conveyed electrostatic latent image, and forms a toner image. The formed toner image is transferred to a recoding medium (e.g. a sheet or a paper) by the transfer unit 114. The cleaning unit 115 removes excessive toner remained on the surface of the photosensitive drum 110. This series of process is executed whenever the photosensitive drum rotates.

The sheet is supplied from the plurality of sheet feed cassettes 116 provided to the multifunction peripheral 100, such as an upper cassette 116*a*, a middle cassette 116*b*, a lower left cassette 116*c*, or a lower right cassette 116*d*. The plurality of sheet feed cassettes 116 stores a different type of sheet respectively. When the sheet is conveyed, the pickup rollers 117 pulls the sheet out to a conveyance path from one of the sheet feed cassettes 116*a* to 116*d*. The sheet feed cassette 116*a* to 116*d*, from which the sheet is pulled out, is decided based on the setting that the user has inputted to the operation unit 102.

The sheet pulled to the conveyance path is sent to a transfer point D between the photosensitive drum 110 and the transfer unit 114 by conveyance rollers 118 and resist rollers 119, on which the toner image based on the image data of the front surface is transferred. And then the sheet is conveyed to a fixing unit 121.

When the sheet on which the toner image is transferred is passing between a heat roller 122 and a pressure roller 123, which are provided to the fixing unit 121, the toner image is fixed on the sheet by applying the heat and pressure on the toner image. The quantity of heat of the heat roller 122 is predetermined optimally depending on the kind of sheet, and the fixing is executed appropriately.

The sheet on which the front surface of the image is formed is conveyed from the fixing unit 121 to a specific junction A that is nearest to the fixing unit 121. The junction A is connected with a conveyance path B for conveying the sheet to a copy receiving tray 124 and a duplex printing conveyance path C for the duplex printing.

In order to form the image data based on the back surface of the original P, the sheet, on which the image data of the front surface of the original P is formed, is guided to the duplex printing conveyance path C, reversed, and conveyed to the transfer point D between the photosensitive drum 110 and the transfer unit 114. Before the sheet arrives at the transfer point D, the toner image is formed on the photosensitive drum 110 based on the image data of the back surface. When the sheet arrives at the transfer point D, the toner image of the image data of the back surface is appropriately transferred to a back of the sheet.

After the toner image of the image data of the back surface was transferred to the back of the sheet, the sheet is conveyed to the fixing unit 121 again, and the fixing is executed. The image data of the back surface of the original P is printed on the sheet.

The duplex-printed sheet is conveyed from the fixing unit 121 to the junction A, and conveyed from the junction A to the convey path B guiding to the copy receiving tray 124, and then loaded on the copy receiving tray 124.

The copy receiving tray 124 is provided on a side of the multifunction periphery 100, and a tray 125 is also provided in housing of the multifunction peripheral 100. According to the user's setting from the operation units 102, the duplex-printed sheet may be stored on the tray 125.

A manual sheet feed tray 126 is provided on the side of the multifunction peripheral 100 so that the sheets loaded on the tray 126 are conveyed to the transfer point D between the photosensitive drum 110 and the transfer unit 114. When the user loads the plural sheets thereon, inputs a specific condition (e.g. the selected sheet; "manual sheet feed tray"), and presses the start key, a conveyance roller 126A nearby the manual sheet feed tray 126 is rotated and the sheet on the manual sheet feed tray 126 is conveyed to the transfer point D between the photosensitive drum 110 and the transfer unit 114. According to the above structure, the multifunction peripheral 100 can transfer the toner image on the photosensitive drum 110 to any sheet other than the sheets in the sheet feed cassettes.

The printing process as described above is the basic duplex printing in the multifunction peripheral 100. The multifunction peripheral 100 can execute a simplex printing by conveying the sheet to the conveyance path B without conveying the sheet to the duplex print conveyance path C.

Figure 2:
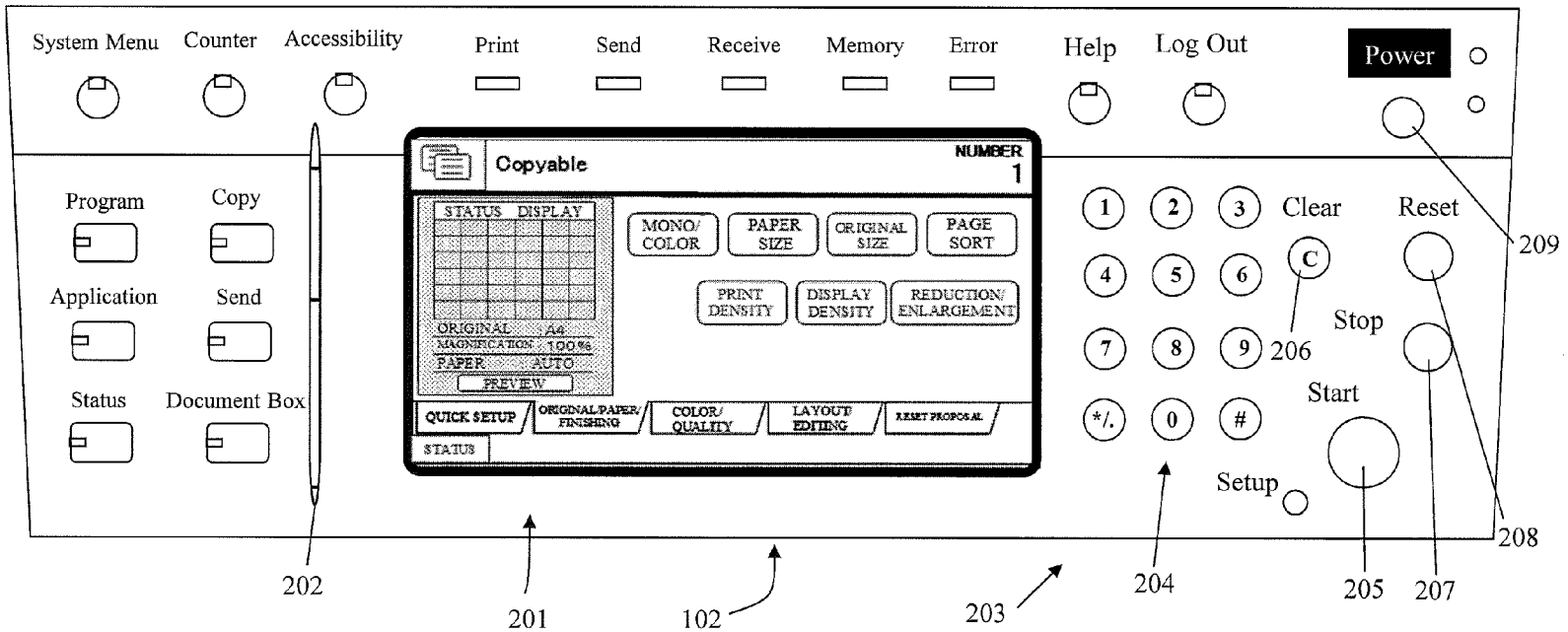
FIG. 2 is a conceptual view showing a whole structure of an operation unit in accordance with an embodiment of the present disclosure.

The user inputs the setting conditions for the image forming processing as above, and confirms the inputted setting conditions uses the operation unit 102 as shown in FIG. 2. When the setting condition is inputted, the user uses a touch panel 201 (an operation panel), a touch pen 202, and an operation key 203 that are provided to the operation unit 102.

The touch panel 201 includes both an input function of the setting condition and a display function of the setting condition. That is, when the user presses down the key that is displayed on the touch panel 201, the setting condition is inputted corresponding to the pressed key.

A display unit (not shown) such as LCD (Liquid Crystal Display) is provided on a back of the touch panel 201. The display unit displays an operation screen, such as an initial screen, for example. The touch pen 202 is provided nearby the touch panel 201, and when the user touches the touch panel 201 with a tip of the touch pen 202, a sensor under the touch panel 201 detects the contact of the tip.

Nearby the touch panel 201, a specific number of operation keys 203 are arranged, such as a ten key 204, a start key 205, a clear key 206, a stop key 207, a reset key 208, and a power key 209, for example.

Figure 3:
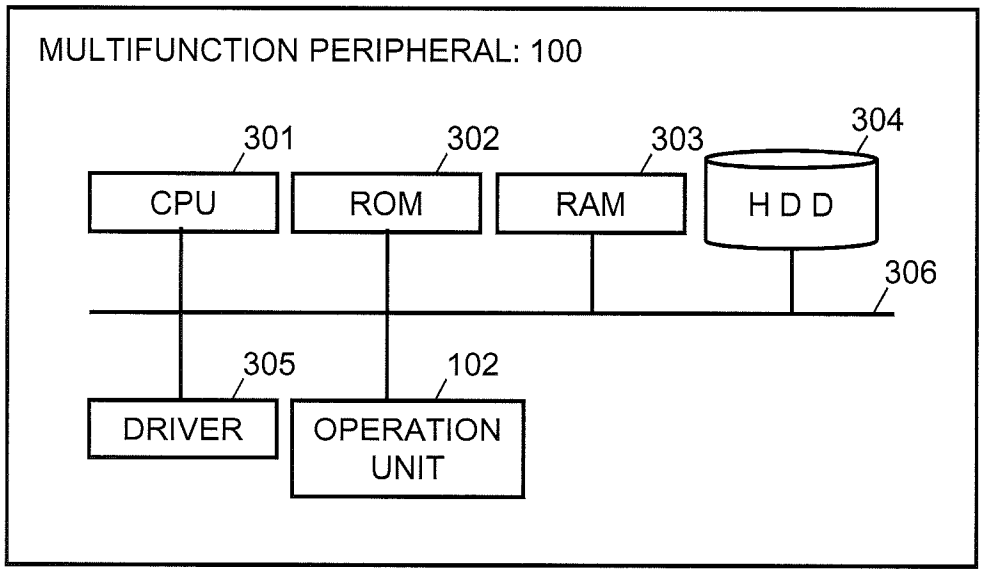
FIG. 3 is a block diagram showing control system hardware of the multifunction peripheral in accordance with an embodiment of the present disclosure.

With reference to FIG. 3, the structure of control system hardware of the multifunction peripheral 100 is explained here. The parts that do not have direct relation to the present disclosure are explained briefly, and the details are omitted.

A control circuit of the multifunction peripheral 100 is configured to connect a CPU (Central Processing Unit) 301, a ROM (Read Only Memory) 302, a RAM (Random Access Memory) 303, a HDD (Hard Disk Drive) 304, a driver 305 corresponding to each driving unit, and an operation unit 102 through an internal bus 306.

The CPU 301 uses the RAM 303 as a working area, for example, executes programs stored in the ROM 302 and the HDD 304, receives data, instructions, signals, and commands from the driver 305 and the operation unit 102 according to the execution result, and controls the operation of each driving unit shown in FIG. 1.

In addition, the CPU can materialize each unit other than the driving unit (shown in FIG. 4) by executing the programs. The ROM 302 and the HDD 304 store the programs and data for materialize each units described below.

Embodiment of the Present Invention

Figure 4:
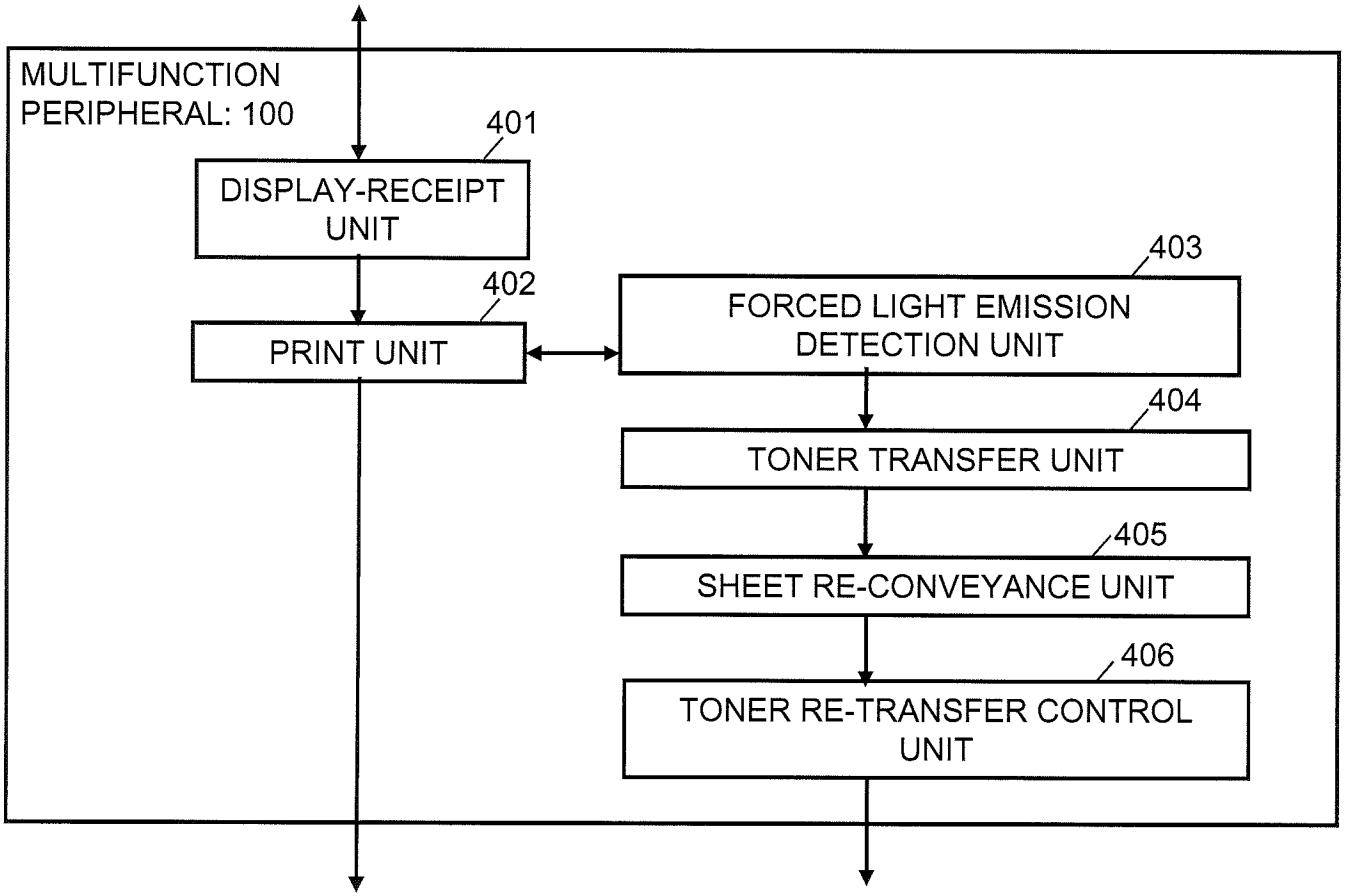
FIG. 4 is a functional block diagram of the multifunction peripheral in accordance with an embodiment of the present disclosure.
Figure 5:
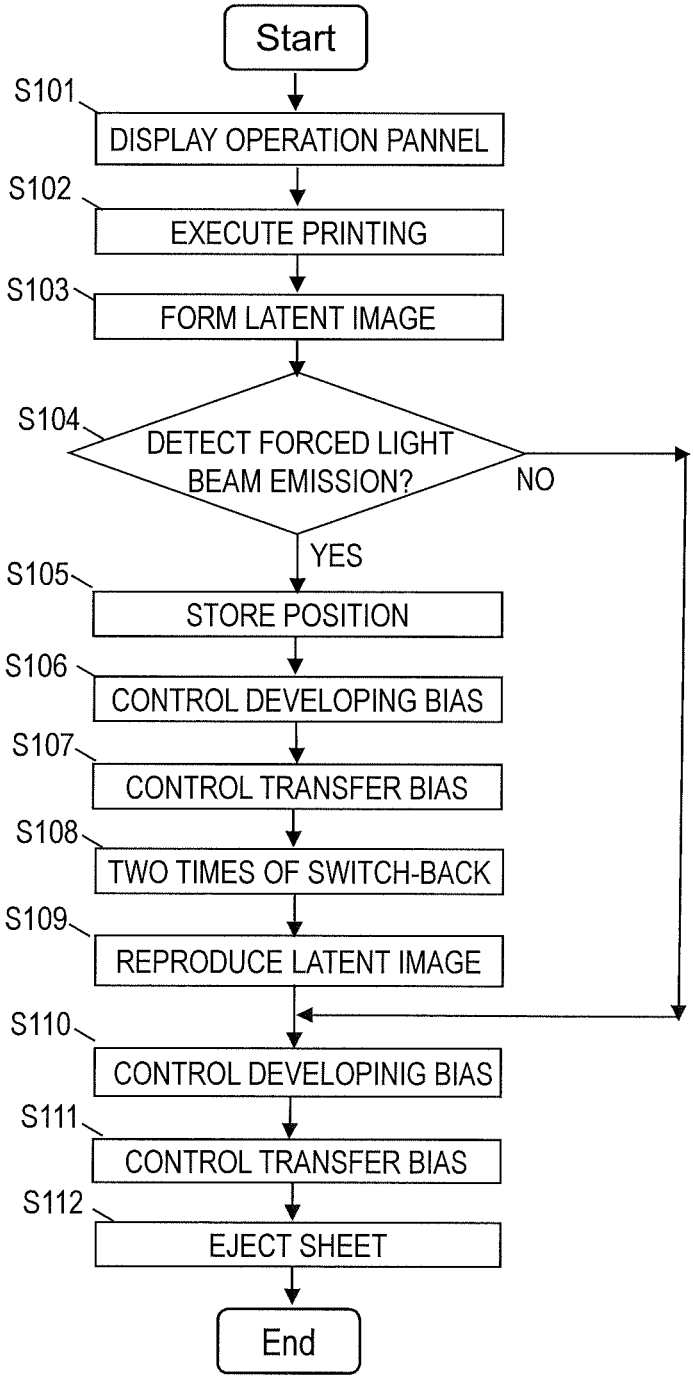
FIG. 5 is a flowchart indicating execution steps of the present disclosure.

With reference to FIG. 4 and FIG. 5, the structure and the execution procedure in accordance with embodiments of the present disclosure are explained hereinafter.

When the user turns on the power of the multifunction peripheral 100, the multifunction peripheral is activated and a display-receipt unit 401 displays the operation screen on the touch panel 201 (FIG. 5: S101).

The operation screen displays a specific message, "Copyable", and function item keys for inputting the setting condition for the copy function and the like, as shown in FIG. 2.

The user places the original P on the original plate 101 and operates the keys watching the operation screen. When the user inputs his desired setting condition (e.g. the sheet size: "A4") and presses down the start key 205, the display-receipt unit 401 receives the input of the setting condition and sends the inputted setting condition to a print unit 402. Upon receipt of the setting condition, the print unit 402 starts the printing based on the setting condition (FIG. 5: S102).

At the beginning of the printing by the print unit 402, the image reading unit 103 reads the original P to form the image data. In the printing unit 402, the charging unit 111 electrifies the surface of the photosensitive drum 110, the exposing unit 112 irradiates the laser beam corresponding to the image data on the photosensitive drum 110, and the image forming unit 109 forms an electrostatic latent image on the photosensitive drum 110 corresponding to the image data.

When the exposing unit 112 starts emitting the laser beam (FIG. 5: S103), the print unit 402 notifies a forced light emission detection unit 403 of the laser beam emission. Upon receipt of the notice, the forced light emission detection unit 403 detects a forced laser beam emission state that the exposing unit 112 emits the laser beam continuously (FIG. 5: S104).

Figure 6A:
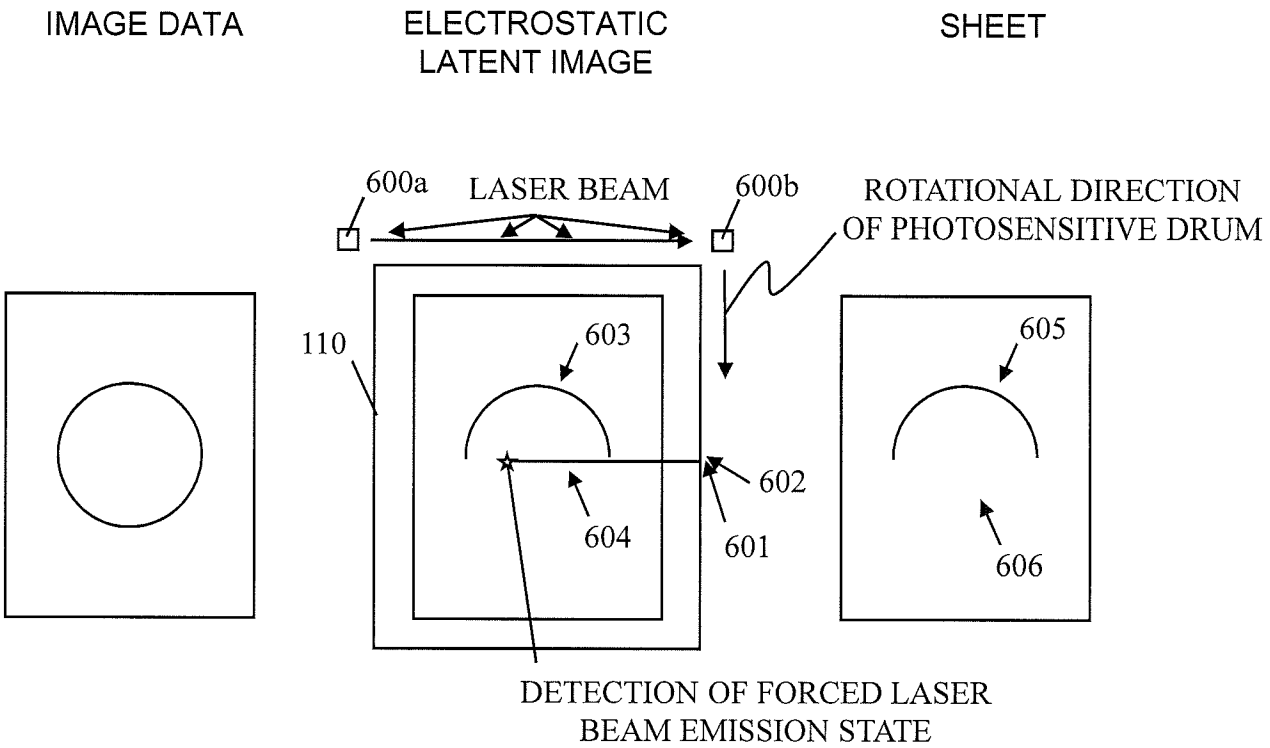
FIG. 6A is views indicating an image data, a latent image and a sheet, when the forced laser beam emission state is detected, in accordance with an embodiment of the present disclosure.

The method that the forced light emission detection unit 403 detects the forced laser beam emission state is not limited in particular, but it may be configured as follows. As shown in FIG. 6A, the exposing unit 112 irradiates the laser beam on the photosensitive drum 110 in a scanning direction (a lateral direction of the image data) corresponding to a line of a specific direction (the lateral direction of the image data) of the read image data, and forms the electrostatic latent image on the photosensitive drum 110. At this time, it is necessary to detect a position of starting the laser beam emission (a writing start position) corresponding to a first line of the image data by adjusting the time of emitting the laser beam on the photosensitive drum 110.

At a top position (an upstream position) of a direction orthogonal to the rotation direction of the photosensitive drum 110 (the scanning direction of the exposing unit 112), a BD signal detection sensor 600*a* for forming the electrostatic latent image is disposed in advance. When the BD signal detection sensor 600*a* receives the laser beam emitted from the exposing unit 112 while the photosensitive drum 110 is rotating, the print unit 402 detects the time of receiving the laser beam as a start time for forming the electrostatic latent image (a receipt time of BEAM DETECT signal).

After the start time is detected, the exposing unit 112 emits the laser beam so as to correspond to the image data. According to the control of the laser beam emission, the image data does not exist at the end position (a downstream position) of the direction orthogonal to the rotation direction of the photosensitive drum 110 (the scanning direction of the exposing unit 112), and the laser beam is not irradiated on an end position.

When the exposing unit 112 becomes the forced laser beam emission state, the laser beam is emitted continuously and irradiated on the end position of the direction orthogonal to the rotation direction of the photosensitive drum 110. Therefore, it is configured in the present disclosure of this embodiment that a light receiving element 600*b* for receiving the laser beam is disposed at the end position of the direction orthogonal to the rotation direction of the photosensitive drum 110 as a detection sensor for detecting the forced laser beam state. The forced light emission detection unit 403 monitors a signal of the light receiving element 600*b*, and detects whether or not the exposing unit 112 is in the forced laser beam emission state. Besides, the above method is only an example, and the other detection means may detects the forced laser beam emission state.

When the exposing unit 112 becomes the forced laser beam emission state due to any external factor while the print unit 402 is forming the electrostatic latent image on the photosensitive drum by the laser beam emitted from the exposing unit 112, the forced light emission detection unit 403 detects that the exposing unit 112 is in the forced laser beam emission state (FIG. 5: S104 YES), and changes the exposing unit to the normal state by resetting the exposing unit (cancel the forced laser beam emission state), and sends a reset notice to a toner transfer control unit 404. Upon receipt of the notice, the toner transfer control unit 404 performs the developing by moving the toner only to the electrostatic latent image formed in front of the position on which the forced laser beam emission state is detected, and the developed toner image is transferred on the sheet.

The method that the toner transfer control unit 404 controls the developing by the toner and the transfer of the toner image is not limited in particular, but it may be configured as follows. As shown in FIG. 6A, the toner transfer control unit 404 specifies a first position 601 on the electrostatic latent image at a time of detecting the forced laser beam emission state, and then specifies a second position 602 before one line of the first position 601 in the scanning direction of the laser beam for the electrostatic latent image. The toner transfer control unit 404 determines that an electrostatic latent image 603 formed before the second position 602 is a normal electrostatic latent image.

On the other hand, there is a high possibility that the electrostatic latent image formed after the second position 602 is formed by the laser beam irradiation in the forced laser beam emission state, and it is the electrostatic latent image in a line shape. Therefore, the toner transfer control unit 404 determines that an electrostatic latent image 604 formed after the second position 602 is an abnormal electrostatic latent image. And then, the toner transfer control unit 404 stores the second position 602 of the electrostatic latent image in a predetermined memory (FIG. 5: S105), and the second position 602 is applied to the timing of the toner transfer.

Before the second position 602 of the electrostatic latent image faces the developing unit 113 after the electrostatic latent image on the photosensitive drum 110 faces the developing unit 113, (namely, during a period that the normal electrostatic latent image 603 on the photo sensitive drum 110 faces the developing unit 113), the toner transfer control unit 404 allows the toner to transfer only the normal electrostatic latent image 603 by applying the developing bias for transferring the toner to the electrostatic latent image. In addition, before the electrostatic latent image goes through the developing unit 113 after the second position 602 of the electrostatic latent image faces the developing unit 113, (namely, during a period that the abnormal electrostatic latent image 604 on the photo sensitive drum 110 faces the developing unit 113), the toner transfer control unit 404 stops the toner transferring to the abnormal electrostatic latent image 604 by stopping the application of the developing bias (FIG. 5: S106). Hereby, it is possible to transfer only the toner to the normal electrostatic latent image 603.

The toner transfer control unit 404 conveys a sheet corresponding to the setting condition from a specific sheet feed cassette 116. After the resist roller 119 matches the conveyance time of the sheet to the toner image on the photosensitive drum 110, the sheet is conveyed to the transfer point D between the photosensitive drum 110 and the transfer unit 114. During a period that the toner image corresponding to the normal electrostatic latent image 603 faces the transfer unit 114, the toner transfer control unit 404 transfers the toner image corresponding to the normal electrostatic latent image 603 on the sheet by applying the transfer bias on the transfer unit 114. In addition, the toner transfer control unit 404 stops the application of the transfer bias on the transfer unit 114 after the toner image corresponding to the normal electrostatic latent image 603 (FIG. 5: S107). Hereby, as shown in FIG. 6A, only a toner image 605 corresponding to the normal electrostatic latent image 603 is transferred to the sheet, and a part 606 corresponding to the abnormal electrostatic latent image 604 becomes blank. The sheet is conveyed to the fixing unit 121 and the toner image is fixed.

In the above description, the transfer of the toner and the toner image by the toner transfer control unit 404 is performed by controlling the applications of the developing bias and the transfer bias, but it may be performed by controlling the application of the developing bias or the transfer bias.

The toner transfer control unit 404 finishes the transfer of the toner, which is notified to a sheet re-conveyance unit 405. Upon receipt of the notice, the sheet re-conveyance unit 405 makes the sheet be in a re-conveyance state, using the duplex print conveyance path C, the sheet on which the toner image 605 corresponding to the normal electrostatic latent image 603 is transferred (FIG. 5: S108).

The method that the sheet re-conveyance unit 405 makes the sheet be in the re-conveyance state, the sheet on which only the toner image 605 corresponding to the normal electrostatic latent image 603 is transferred, is not limited in particular, but it may be configured as follows. The sheet re-conveyance unit 405 reverses the sheet on which the toner image 605 corresponding to the normal electrostatic latent image 603 is transferred by letting the sheet go through the duplex print conveyance path C, and conducts the sheet to the transfer point D between to the photosensitive drum 110 and the transfer unit 114, and then conveys the sheet to the duplex print conveyance path C again. At this time, the sheet re-conveyance unit 405 controls the transfer unit and the fixing unit not to drive.

The sheet, on which the toner image 605 corresponding to the normal electrostatic latent image 603 is transferred, is in a state of the back surface, so the sheet re-conveyance unit 405 reverses the sheet by letting the sheet go through the duplex print conveyance path C (two times of switchback). According to such configuration, the sheet on which the toner image 605 corresponding to the normal electrostatic latent image 603 is transferred is turn to the front surface and changed to the re-conveyance state.

When the sheet becomes the re-conveyance state, the sheet re-conveyance unit 405 notifies a toner re-transfer control unit 406 of the state. Upon receipt of the notice, the toner re-transfer control unit 406 reforms the electrostatic latent image to be formed after the second position 602 on which the forced laser beam emission state is detected, and performs the developing by moving the toner to the electrostatic latent image, and the toner image formed by the developing is transferred on the sheet in the re-conveyance state.

Figure 6B:
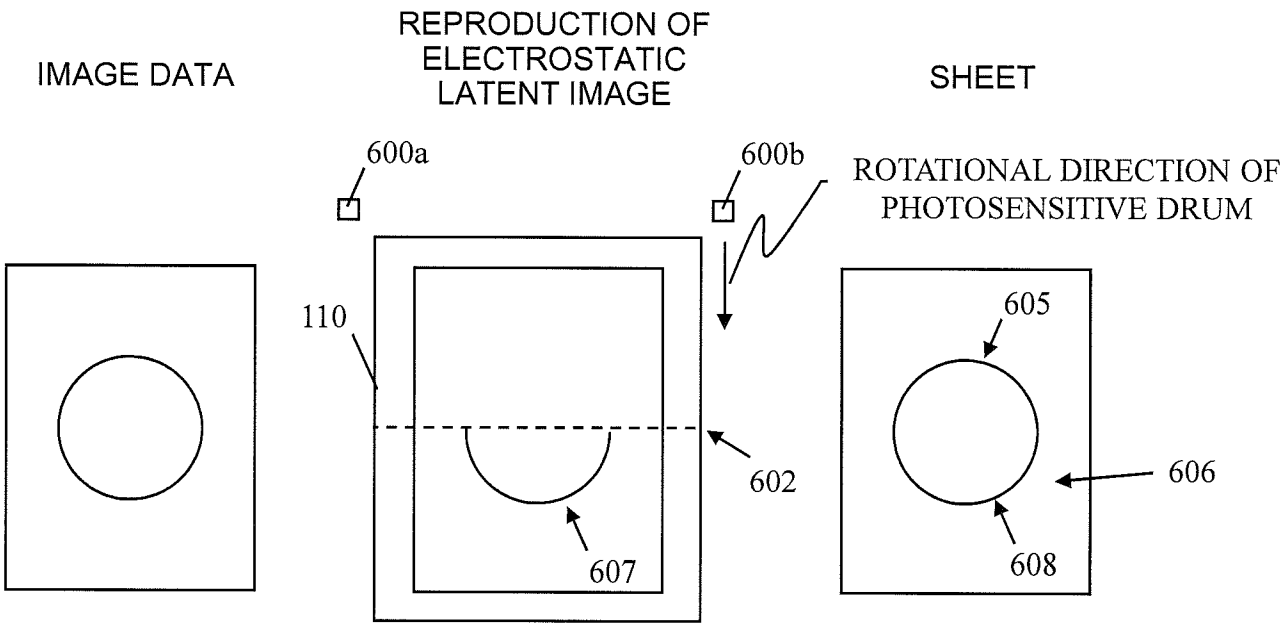
FIG. 6B is views indicating an image data, a latent image and a sheet, after the forced laser beam emission state is detected, in accordance with an embodiment of the present disclosure.

The method that the toner re-transfer control unit 406 transfers the toner image formed by the developing to the sheet in the re-conveyance state is not limited in particular, but it may be configured as follows. The toner re-transfer control unit 406 reproduces on the photosensitive drum 110 the electrostatic latent image 607 to be formed after the second position 602 by controlling the laser beam emission of the exposing unit 112, based on the second position 602 stored in the memory, as shown in FIG. 6B (FIG. 5: S109). The reproduced electrostatic latent image 607 is the abnormal electrostatic latent image 604 in FIG. 6A. The normal electrostatic latent image 603 has been fixed as the toner image on the sheet, and the toner re-transfer control unit 406 does not form the normal electrostatic latent image 603, at this time.

Next, the toner re-transfer control unit 406 applies the developing bias on the developing unit 113, and performs the developing by moving the toner to the reproduced electrostatic latent image 607 (FIG. 5: S110), and only the toner image formed by the developing is formed on the photosensitive drum 110. After the resist roller 119 matches the conveyance time of the sheet in the re-conveyance state to the toner image on the photosensitive drum 110, the toner re-transfer control unit 406 conveys the sheet in the re-conveyance state to the transfer point D when the toner image formed on the photosensitive drum 110 arrives at the transfer point D, and transfers the toner image 608 of the reproduced electrostatic latent image 607 on the blank part 606 of the sheet by applying the transfer bias on the transfer unit 114, as shown in FIG. 6B (FIG. 5: S111).

The toner re-transfer control unit 406 conveys the sheet to the fixing unit 121, and fixes the toner image 608, and ejects the sheet as the printed matter to a specific copy receiving tray 124 (or the tray 125) (FIG. 5: S112). Hereby, even in the forced laser beam emission state, it is possible to prevent the abnormal printing and obtain the printed matter that the user has desired.

At the step S104, when the forced light emission detection unit 403 does not detect that the exposing unit 112 is in the forced laser beam emission state (FIG. 5: S104 YES), the electrostatic latent image corresponding to the image data is appropriately formed on the photosensitive drum 110. In this case, the print unit 402 moves the toner to the electrostatic latent image by applying the developing bias on the developing unit 113 in the usual method (FIG. 5: S110), and transfers the toner image of the electrostatic latent image on the sheet by applying the transfer bias on the transfer unit 114 (FIG. 5: S111). And then, the print unit 402 ejects the sheet on which the toner image is transferred to the specific copy receiving tray 124 as the printed matter, without using the duplex print conveyance path C (FIG. 5: S112).

As described above, the present disclosure can prevent the abnormal image printing even in the forced laser beam emission state.

Besides, it is configured in the embodiment of the present disclosure that the toner image on the photosensitive drum 110 is transferred directly on the sheet via the transfer unit 114, but the other configuration may be employed. For instance, it may be configured that the toner image formed on the photosensitive drum 110 is transferred to a specific intermediate transfer belt, and the toner image transferred to the intermediate transfer belt is transferred to the sheet.

In the embodiment of the present disclosure, the multifunction peripheral 100 is configured to include each unit, but it may be configured by providing with the storage medium storing the program realizing the respective units. In such configuration, the program is read onto the image forming apparatus, and the image forming apparatus realizes the respective units. In this case, the program read from the storage medium can provide with the same effect as the present disclosure. In addition, it is possible to provide with the method for storing the steps executed by each unit in the hard disk.

What is claimed is:

1. An image forming apparatus comprising:

a forced light emission detection unit for detecting a forced laser beam emission state that an exposing unit irradiates a laser beam continuously when the exposing unit starts forming a latent image on a photosensitive drum;

a toner transfer control unit for performing the developing by moving a toner to the electrostatic latent image formed at a position before the electrostatic latent image on which the forced laser beam emission is detected when the exposing unit is in a forced laser beam emission state, and transferring a toner image formed by the developing to a sheet;

a sheet re-conveyance unit for making the sheet being in a re-conveyance state by means of a duplex printing conveyance path, the sheet on which the toner image is transferred; and a toner re-transfer control unit for reforming the electrostatic latent image formed after the position on which the forced laser beam emission state is detected, performing the developing by moving the toner to the electrostatic latent image, and transferring the toner image formed by the developing to the sheet in the re-conveyance state, wherein the forced light emission detection unit detects that the exposing unit is in the forced laser beam emission state when a light receiving element provided to an end of a direction orthogonal to a rotation direction of a photosensitive drum receives the light beam after a start of forming the electrostatic latent image.

2. The image forming apparatus according to claim 1, wherein the toner transfer control unit does not move the toner to the electrostatic latent image formed after the position of the electrostatic latent image on which the forced laser beam emission state is detected.

3. The image forming apparatus according to claim 1, wherein the toner transfer control unit specifies a first position on the electrostatic latent image at a time of detecting the forced laser beam emission state, and specifies a second position before one line of the first position in the scanning direction of the laser beam for the electrostatic latent image, determines the electrostatic latent image formed before the second position is a normal latent image and the electrostatic latent image formed after the second position is an abnormal latent image, and moves the toner to the normal latent image, and stops the toner moving to the abnormal latent image.

4. The image forming apparatus according to claim 1, wherein the toner transfer control unit specifies a first position on the electrostatic latent image at a time of detecting the forced laser beam emission state; specifies a second position before one line of the first position in the scanning direction of the laser beam for the electrostatic latent image; determines the electrostatic latent image formed before the second position is a normal latent image and the electrostatic latent image formed after the second position is an abnormal latent image; moves the toner to the normal latent image by applying a developing bias before the second position of the electrostatic latent image faces the developing unit after the electrostatic latent image on the photosensitive drum faces the developing unit; stops the toner moving to the abnormal latent image by stopping the application of the developing bias before the electrostatic latent image goes through the developing unit after the second position of the electrostatic latent image faces the developing unit; transfers the toner image corresponding to the normal latent image to the sheet by applying a transfer bias while the toner image corresponding to the normal latent image is facing the transfer unit; and stops the application of the transfer bias after the toner image corresponding to the normal latent image.

5. The image forming apparatus according to claim 1, wherein the sheet re-conveyance unit controls not to drive a transfer unit and a fixing unit; reverses the sheet on which the toner image is transferred by making the sheet go through the duplex printing conveyance path; makes the sheet go through a transfer point between the photosensitive drum and the transfer unit; re-conveys the sheet to the duplex printing conveyance path; turns the sheet to a front surface by turning over the sheet on which the toner image is transferred by passing through the duplex printing conveyance path; and makes the sheet in a re-conveyance state.

6. The image forming apparatus according to claim 1, wherein the toner transfer control unit specifies a first position on the electrostatic latent image at a time of detecting the forced laser beam emission state; specifies a second position before one line of the first position in the scanning direction of the laser beam for the electrostatic latent image; determines the electrostatic latent image formed before the second position is a normal latent image and the electrostatic latent image formed after the second position is an abnormal latent image; moves the toner to the normal latent image; stops the toner transfer to the abnormal latent image, and the toner transfer control unit reproduces the electrostatic latent image to be formed after the second position by controlling the laser beam emission of the exposing unit based on the second position, and moves the toner to the electrostatic latent image, and transfers the reproduced electrostatic latent image on a blank part of the sheet in the re-conveyance state.

7. The image forming apparatus according to claim 1, wherein the toner transfer control unit specifies a first position on the electrostatic latent image at a time of detecting the forced laser beam emission state; specifies a second position before one line of the first position in the scanning direction of the laser beam for the electrostatic latent image; determines the electrostatic latent image formed before the second position is a normal latent image and the electrostatic latent image formed after the second position is an abnormal latent image; stores the second position in a specific memory; moves the toner to the normal latent image; and stops the toner moving to the abnormal latent image, and the toner transfer control unit does not form the normal electrostatic latent image by controlling the laser beam emission of the exposing unit based on the second position stored in the specific memory; reproduces on the photosensitive drum the electrostatic latent image to be formed after the second position; moves the toner to the reproduced electrostatic latent image, forms the toner image formed on the photosensitive drum by the toner moving, and transfers the reproduced toner image of the electrostatic latent image to a blank part on the sheet by conveying the sheet in the re-conveyance state to a transfer point at a timing that the toner image formed on the photosensitive drum arrives at the transfer point between the photosensitive drum and the transfer unit after the conveyance timing of the sheet in the re-conveyance state meets the toner image on the photosensitive drum.

8. An image forming method comprising steps of:

a forced light emission detection step of detecting a forced laser beam emission state that an exposing unit irradiates a laser beam continuously when the exposing unit starts forming a latent image on a photosensitive drum;

a toner transfer control step of performing the developing by moving a toner to the electrostatic latent image formed at a position before the electrostatic latent image on which the forced laser beam emission is detected when the exposing unit is in a forced laser beam emission state, and transferring a toner image formed by the developing to a sheet;

a sheet re-conveyance step of making the sheet being in a re-conveyance state by means of a duplex printing conveyance path, the sheet on which the toner image is transferred; and a toner re-transfer control step of reforming the electrostatic latent image formed after the position on which the forced laser beam emission state is detected, performing the developing by moving the toner to the electrostatic latent image, and transferring the toner image formed by the developing to the sheet in the re-conveyance state, wherein the forced light emission detecting step detects that the exposing unit is in the forced laser beam emission state when a light receiving element provided to an end of a direction orthogonal to a rotation direction of a photosensitive drum receives the light beam after a start of forming the electrostatic latent image.

* * * * *